US008322572B2

(12) United States Patent
White

(10) Patent No.: US 8,322,572 B2
(45) Date of Patent: Dec. 4, 2012

(54) RUSSIAN ROULETTE BEVERAGE DISPENSER

(76) Inventor: Jesse Jonah White, Hardin, IL (US)

( * ) Notice: Subject to any disclaimer, the term of this patent is extended or adjusted under 35 U.S.C. 154(b) by 295 days.

(21) Appl. No.: 12/858,955

(22) Filed: Aug. 18, 2010

(65) Prior Publication Data

US 2011/0042409 A1 Feb. 24, 2011

Related U.S. Application Data

(60) Provisional application No. 61/274,538, filed on Aug. 18, 2009.

(51) Int. Cl.
*A63H 3/18* (2006.01)

(52) U.S. Cl. ..... 222/79; 42/58

(58) Field of Classification Search ..... 222/79, 222/113; 42/54, 55, 57, 58; 124/83, 56, 124/57; 446/473
See application file for complete search history.

(56) References Cited

U.S. PATENT DOCUMENTS

| | | | | | |
|---|---|---|---|---|---|
| 2,698,700 | A * | 1/1955 | Grosh | 222/79 |
| 2,706,067 | A * | 4/1955 | Mills | 222/79 |
| 2,915,221 | A * | 12/1959 | Dillon, Jr. | 222/79 |
| 3,434,512 | A * | 3/1969 | Lowe | 141/18 |
| 3,618,583 | A * | 11/1971 | Pottern | 124/16 |
| 3,733,736 | A * | 5/1973 | Glessner, Sr. | 446/18 |
| 4,058,921 | A * | 11/1977 | Mason | 42/1.08 |
| 4,841,655 | A * | 6/1989 | Ferri | 42/58 |
| 6,026,990 | A * | 2/2000 | Brunswig | 222/153.13 |
| 2002/0116855 | A1 * | 8/2002 | Iten et al. | 42/58 |
| 2006/0151948 | A1 * | 7/2006 | McGanty et al. | 273/248 |
| 2012/0118990 | A1 * | 5/2012 | Beever, III | 239/1 |

* cited by examiner

*Primary Examiner* — Lien Ngo

(74) *Attorney, Agent, or Firm* — Bryan Cave LLP

(57) ABSTRACT

The present disclosure relates to a beverage dispenser formed in the shape of a gun.

21 Claims, 22 Drawing Sheets

RUSSIAN ROULETTE BEVERAGE DISPENSER

CROSS-REFERENCE TO RELATED APPLICATIONS

This application claims the benefit of U.S. Provisional Application No. 61/274,538, filed Aug. 18, 2009, which is incorporated herein by reference in its entirety.

FIELD OF THE INVENTION

The present invention generally relates to a beverage dispenser and a method of using the same in a game of chance similar to Russian Roulette to dispense a beverage.

BACKGROUND OF THE INVENTION

Russian Roulette typically refers to a game of chance in which the players take turns placing a single round or bullet in a revolver, spinning the revolver's cylinder, placing the muzzle of the revolver in their mouths or against the side of their heads, and pulling the trigger. When played with a live round and a six-shot working revolver, there is a one-in-six chance with every turn that the player will fire the live round and sustain an almost-certainly fatal wound. This game of chance, while incredibly dangerous and viewed by most as foolish, is often romanticized, perhaps due to a belief that the players possess a reckless bravado.

A less harmful version of this game of chance would allow players to enjoy the suspense and engage in this game's element of luck without the permanent or fatal consequences. The present invention is directed to a beverage dispenser and method of using the same which utilizes the general underpinnings of the game of Russian Roulette.

SUMMARY OF THE INVENTION

Among the various aspects of the present invention is the provision of a beverage dispenser. The beverage dispenser has the general shape or form of a gun (e.g., a pistol, revolver, musket, rifle, or the like). In certain preferred embodiments, the beverage dispenser is in the shape or form of a revolver and includes a grip, a barrel, a rotatable cylinder, and a trigger.

Briefly, therefore, the present invention is directed to a beverage dispenser comprising a frame. The frame has a front muzzle end and a rear frame end; a grip extending downward from the rear frame end of the frame and adapted to be held in a hand of a user, the grip defining a reservoir for holding a liquid; a barrel projecting forwardly from the front muzzle end and terminating in a muzzle opening having a bore centered on a barrel axis extending rearward towards the rear frame end; and a trigger mechanism comprising a trigger projecting downward from the frame forward of the grip and actuatable by a finger of the hand of the user holding the grip. The dispenser also includes a cylinder received in the frame rearward of the barrel and rotatable about a cylinder axis generally parallel to the barrel axis, the rotatable cylinder having a plurality of closed chambers and at least one open chamber, wherein the open chamber, when positionally aligned with the barrel axis, substantially allows fluid communication between the muzzle opening and the reservoir, and wherein any one of the closed chambers, when positionally aligned with the barrel axis, substantially prevents fluid communication between the muzzle opening and the reservoir. In various preferred embodiments, the frame is formed in the shape of a revolver.

Another aspect of the invention is directed to a beverage dispenser comprising a frame, the frame having a front muzzle end and a rear frame end; a grip extending downward from the rear frame end of the frame and adapted to be held in a hand of a user, the grip defining a reservoir for holding a liquid; a barrel projecting forwardly from the front muzzle end and terminating in a muzzle opening having a bore centered on a barrel axis extending rearward towards the rear frame end; a trigger mechanism comprising a trigger projecting downward from the frame forward of the grip and actuatable by a finger of the hand of the user holding the grip; a cylinder received in the frame rearward of the barrel and rotatable about a cylinder axis generally parallel to the barrel axis, the rotatable cylinder having a plurality of closed chambers and at least one open chamber, wherein the open chamber, when positionally aligned with the barrel axis, substantially allows fluid communication between the muzzle opening and the reservoir, wherein any one of the closed chambers, when positionally aligned with the barrel axis, substantially prevents fluid communication between the muzzle opening and the reservoir, and wherein the trigger mechanism, when actuated by the user, informs the user of the positional alignment of the open and closed chambers. In various preferred embodiments, the frame is formed in the shape of a revolver.

Another aspect of the invention is directed to a beverage dispenser comprising a frame, the frame having a front muzzle end and a rear frame end; a grip extending downward from the rear frame end of the frame and adapted to be held in a hand of a user, the grip defining a chamber for holding cartridge containing a liquid; a barrel projecting forwardly from the front muzzle end and terminating in a muzzle opening having a bore centered on a barrel axis extending rearward towards the rear frame end; a trigger mechanism comprising a trigger projecting downward from the frame forward of the grip and actuatable by a finger of the hand of the user holding the grip; a cylinder received in the frame rearward of the barrel and rotatable about a cylinder axis generally parallel to the barrel axis, the rotatable cylinder having a plurality of closed chambers and at least one open chamber, wherein the open chamber, when positionally aligned with the barrel axis, substantially allows fluid communication between the muzzle opening and the reservoir, wherein any one of the closed chambers, when positionally aligned with the barrel axis, substantially prevents fluid communication between the muzzle opening and the reservoir, and wherein the trigger mechanism, when actuated by the user, informs the user of the positional alignment of the open and closed chambers. In various preferred embodiments, the frame is formed in the shape of a revolver.

Another aspect of the invention is directed to a beverage dispenser comprising an enclosed reservoir capable of holding a liquid, wherein the reservoir has at least one opening into and out of which the liquid can be moved, a revolving or rotating cylinder adjacent to the reservoir, wherein the revolving cylinder has more than one closed chambers housed in the cylinder which do not extend through a length of the cylinder, wherein the closed chambers, when aligned with the reservoir opening, do not permit the passage of liquid out of the reservoir, and wherein the revolving cylinder has one open chamber housed in the revolving cylinder which extends through a length of the cylinder, and when aligned with the reservoir opening, permits the passage of liquid out of the reservoir, and a trigger mechanism connected to the cylinder, which when activated and when said open chamber is aligned with the reservoir opening, the liquid contents of the reservoir can be dispensed through the open chamber and the opening. In one embodiment, the liquid contents can be poured out of the dispenser into a user's mouth. In another embodiment, the liquid contents of the reservoir are propelled through the open chamber and the opening into a user's mouth.

In an embodiment, the reservoir, the cylinder, and the trigger mechanism are substantially housed or fitted in a gun-shaped beverage dispenser, wherein the reservoir is located in the handle or grip of the gun-shaped dispenser, the cylinder is located on or near the barrel of the gun-shaped dispenser, and the trigger mechanism is activated by the pulling or pressing of a trigger on the gun-shaped dispenser.

Another aspect of the invention is directed to a method of playing a game of chance, similar in concept to Russian Roulette, by providing a beverage dispenser described herein and filling the reservoir with a beverage. Once the dispenser is filled, a player spins or rotates the cylinder and pulls the trigger. In an embodiment, the cylinder has six total chambers, five of those chambers being closed chambers, and one chamber being an open chamber. In this embodiment, each player has a one-in-six chance that the open chamber will be positionally aligned with the reservoir and an opening of the dispenser. Pulling or attempting to pull the trigger informs the user about the position of the open and closed cylinders, e.g., whether the open chamber is in a position that will allow a beverage to be dispensed or whether the closed chamber is in a position that will prevent or substantially prevent a beverage from being dispensed. The user may be informed, for example, by an ability or inability to pull or squeeze the trigger (an inability to pull the trigger signifying that a closed chamber will not permit the beverage to be dispensed, and an ability to pull the trigger signifying that the beverage is ready to be dispensed). Additionally or alternatively, the user may be informed of the position of the open and closed chambers by various lights (e.g., LED lights) or sound emitting from the dispenser upon actuation of the trigger. If the player receives an open chamber, the liquid is dispensed into the player's mouth or into another container (e.g., by pouring the liquid out of the dispenser or by a fluid propulsion mechanism that forces the liquid out of the dispenser). If the player receives a closed chamber, the beverage dispenser is passed to another player who repeats the cylinder rotation and trigger actuation step.

Other objects and features will be in part apparent and in part pointed out hereinafter.

BRIEF DESCRIPTION OF THE DRAWINGS

The details of the present invention, both as to its construction and operation can best be understood with reference to the accompanying drawings, in which like numerals refer to like parts, and in which.

DETAILED DESCRIPTION OF THE PREFERRED EMBODIMENTS OF THE INVENTION

Figure 1:
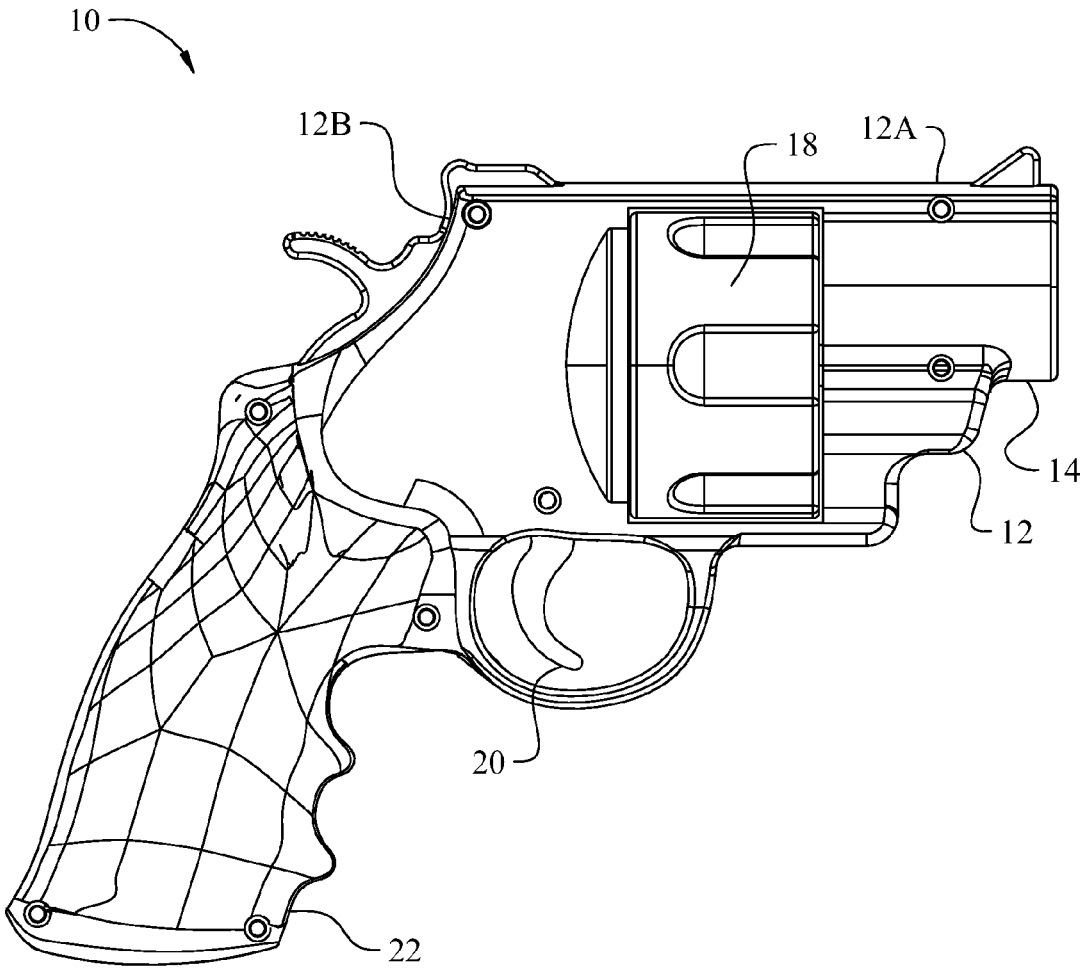
FIG. 1 is a right side view of the beverage dispenser described herein.
Figure 2:
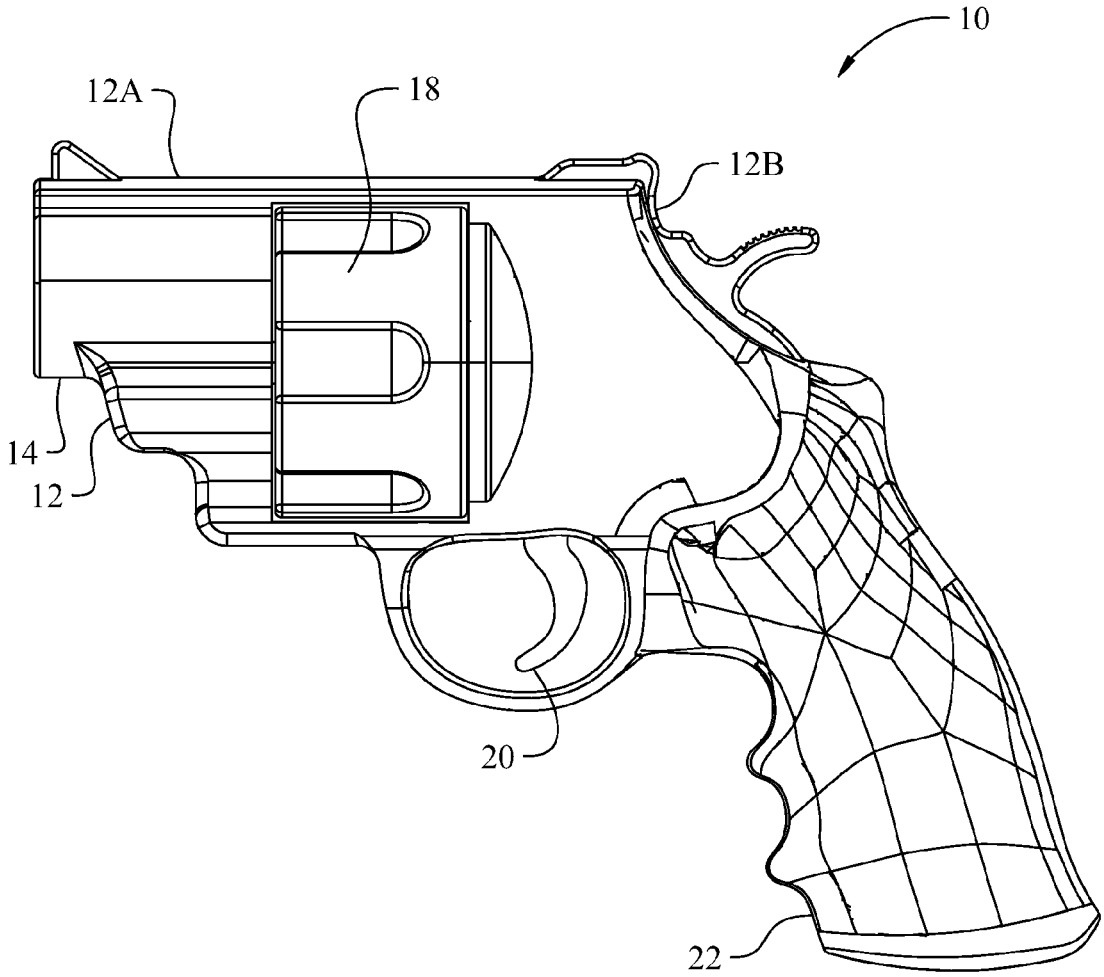
FIG. 2 is a left side view of the beverage dispenser described herein.
Figure 3:
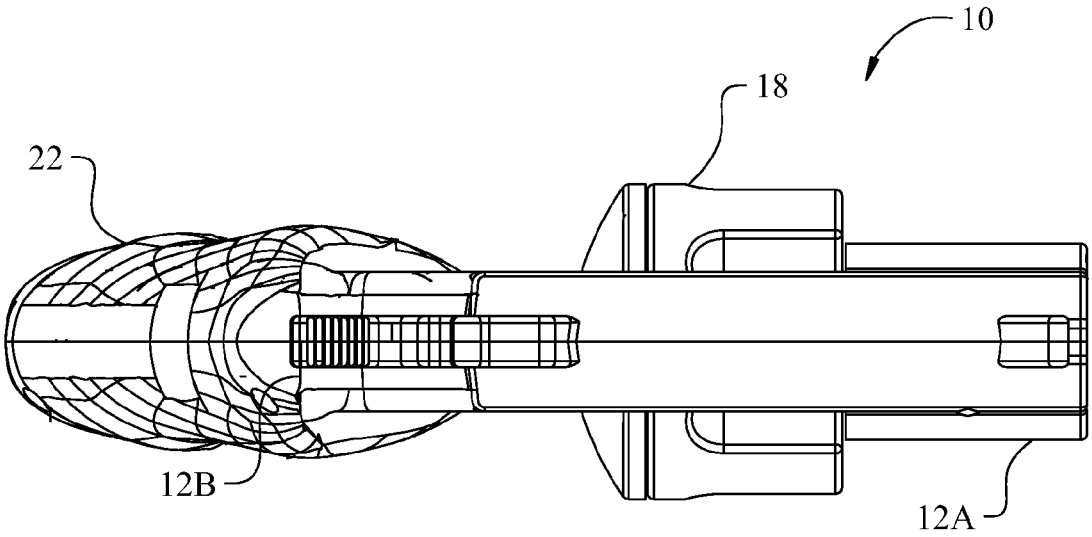
FIG. 3 is a top side view of the beverage dispenser described herein.
Figure 4:
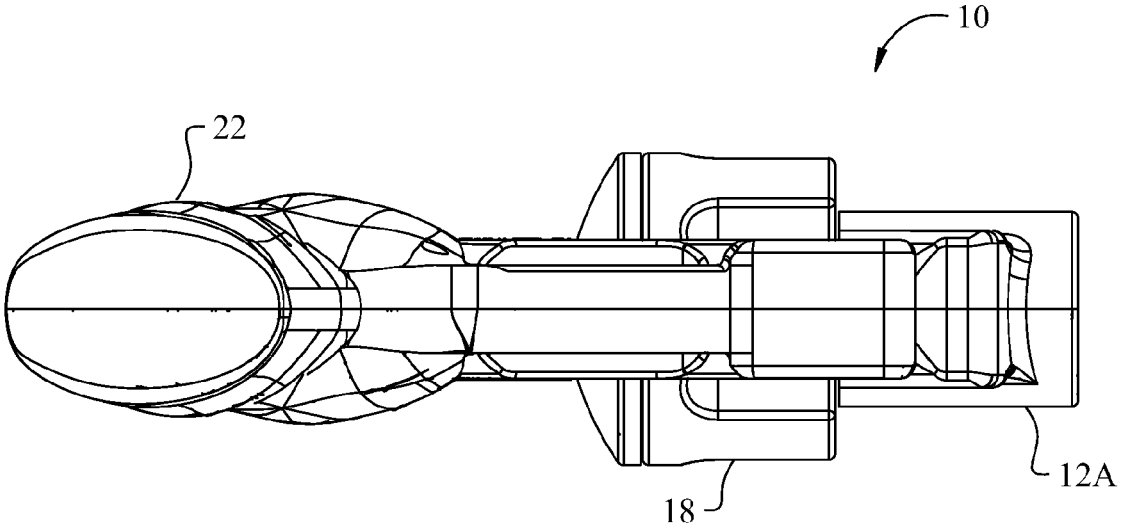
FIG. 4 is a bottom side view of the beverage dispenser described herein.
Figure 5:
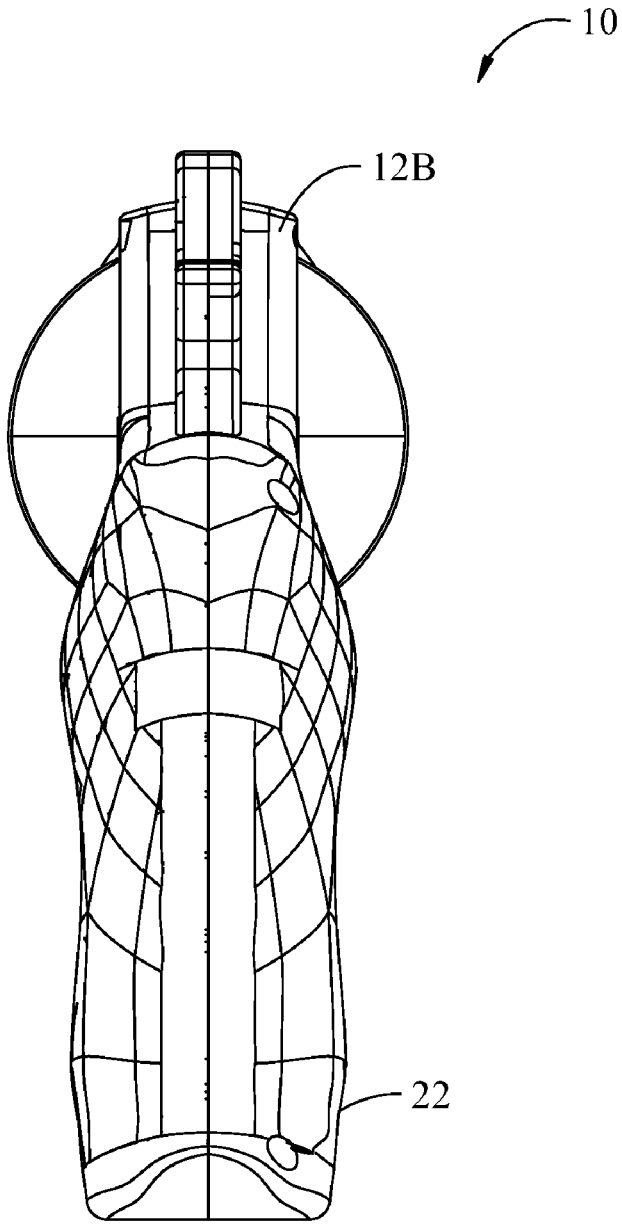
FIG. 5 is a rear side view of the beverage dispenser described herein.
Figure 6:
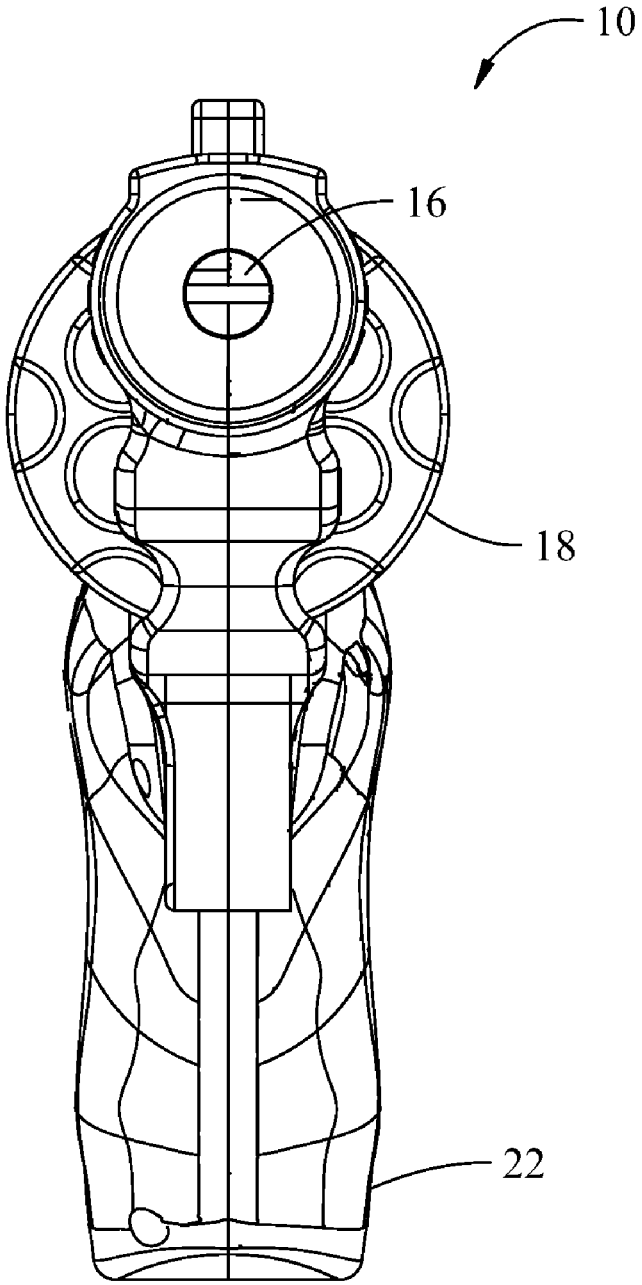
FIG. 6 is a front side view of the beverage dispenser described herein.
Figure 7:
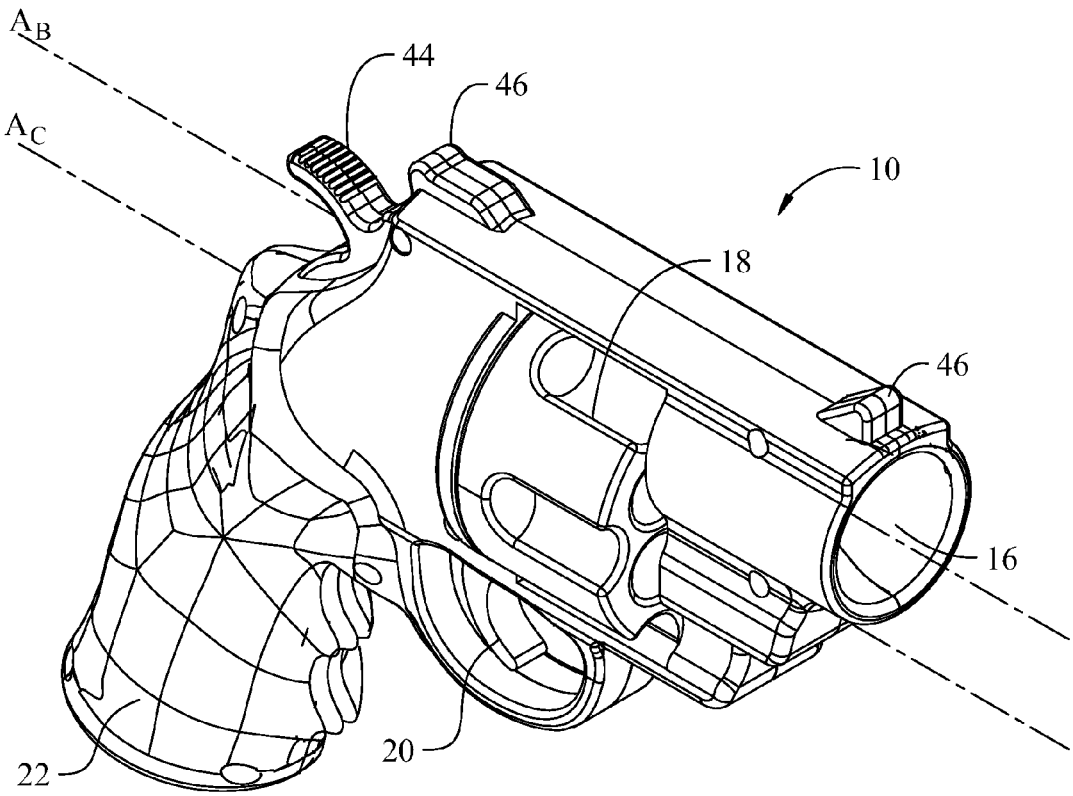
FIG. 7 is a top right side perspective view of the beverage dispenser described herein.
Figure 8:
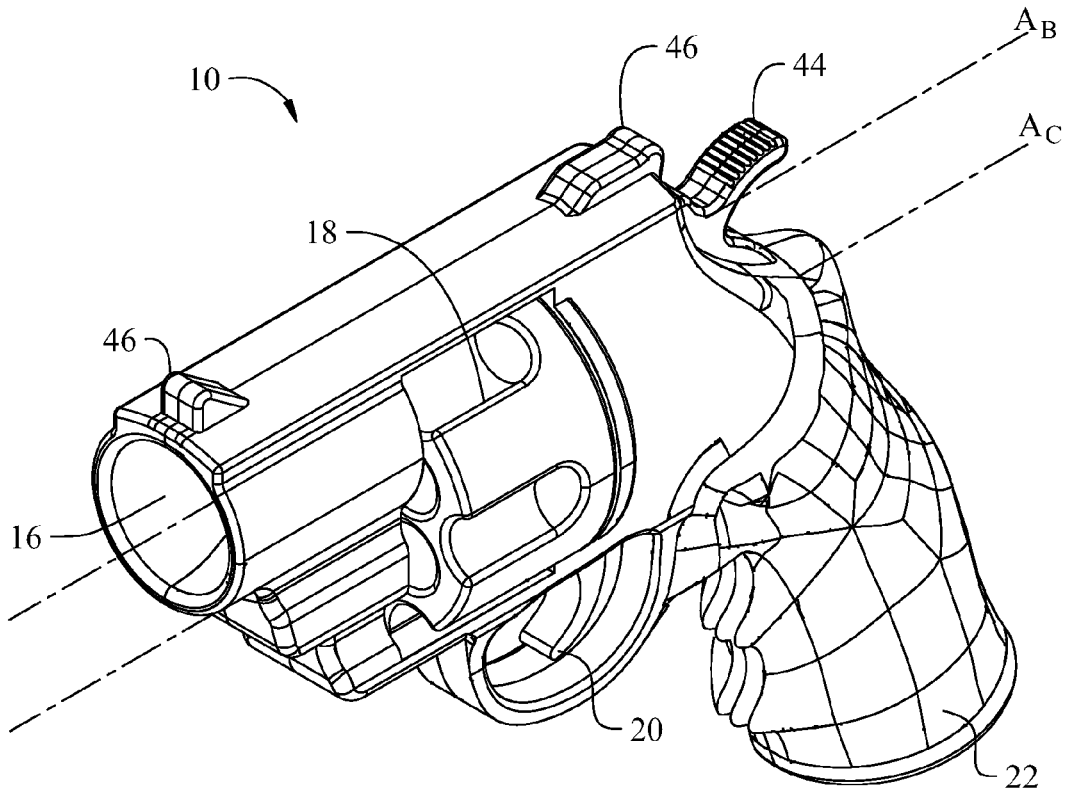
FIG. 8 is a top left side perspective view of the beverage dispenser described herein.
Figure 9:
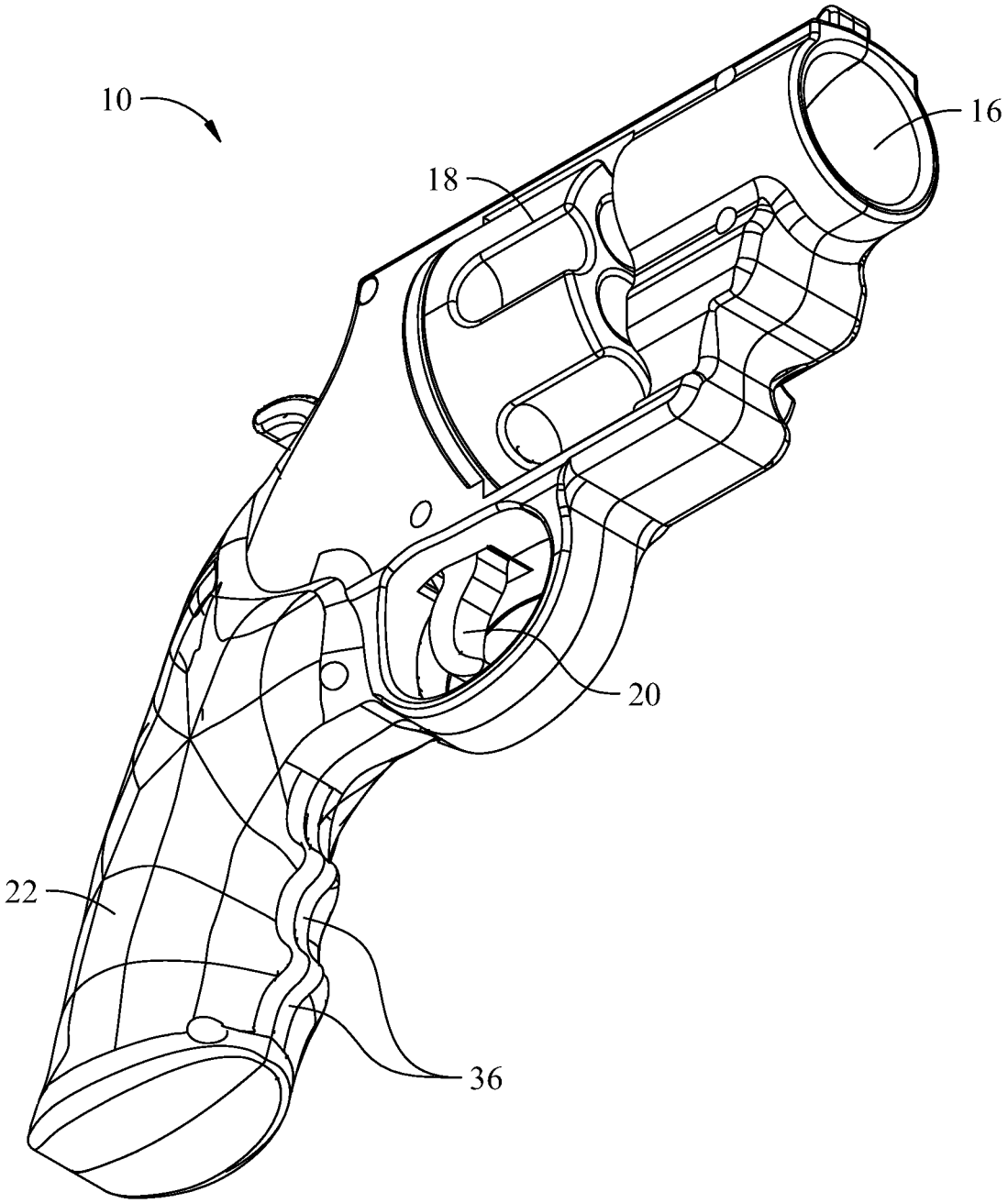
FIG. 9 is a bottom right side perspective view of the dispenser described herein.
Figure 10:
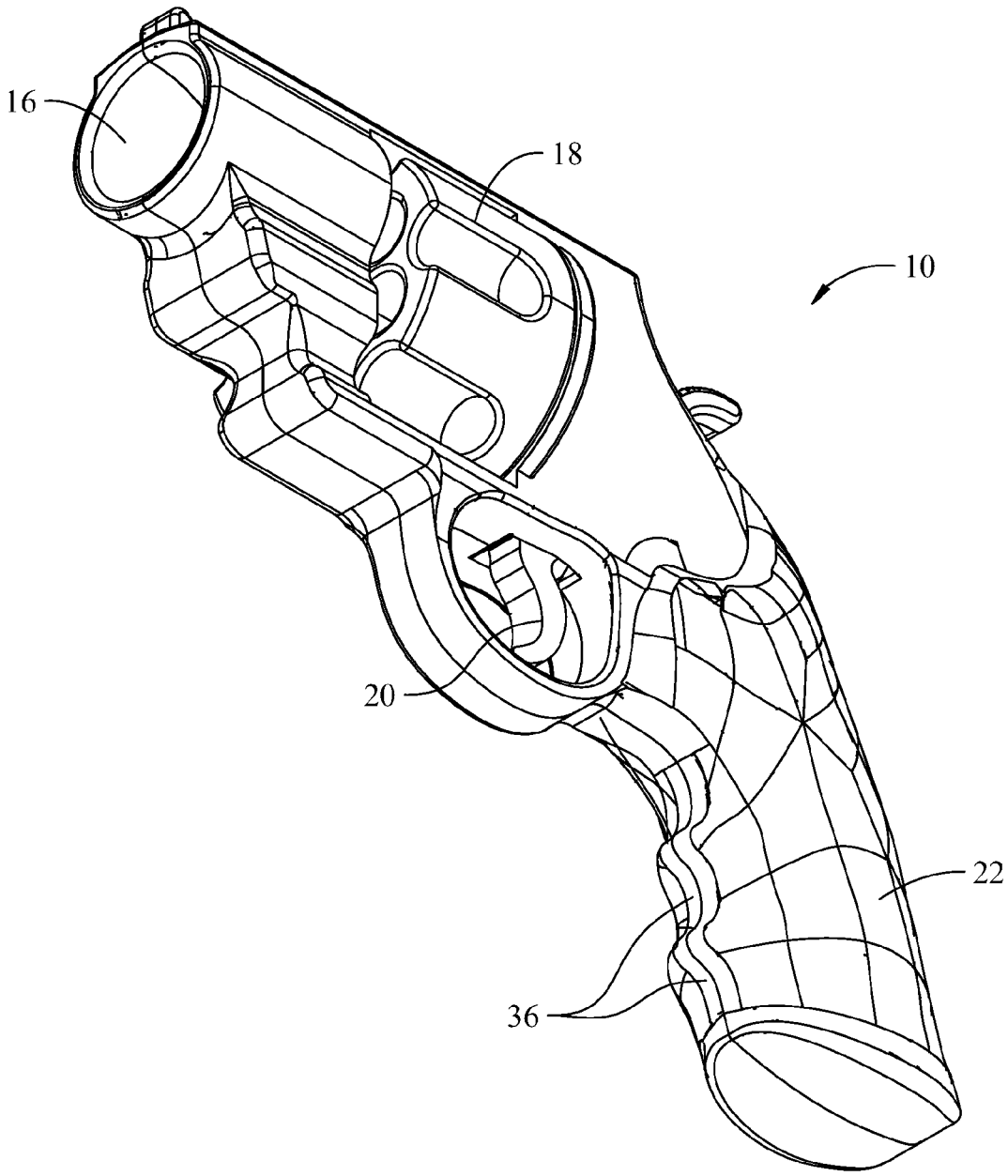
FIG. 10 is a bottom left side perspective view of the dispenser described herein.
Figure 11A:
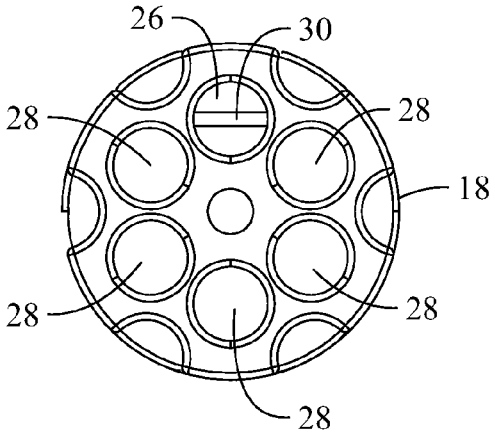
FIG. 11A is a front side view of the cylinder of the beverage dispenser described herein.
Figure 11B:
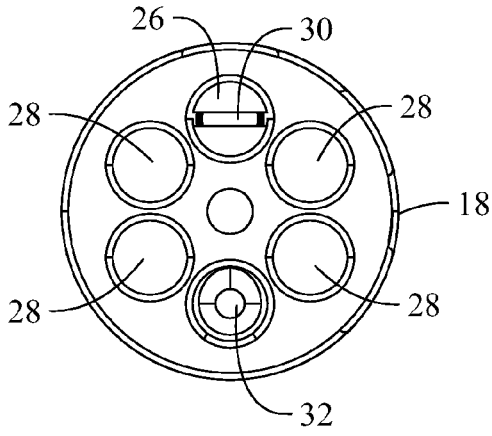
FIG. 11B is a rear side view of the cylinder of the beverage dispenser described herein.
Figure 11C:
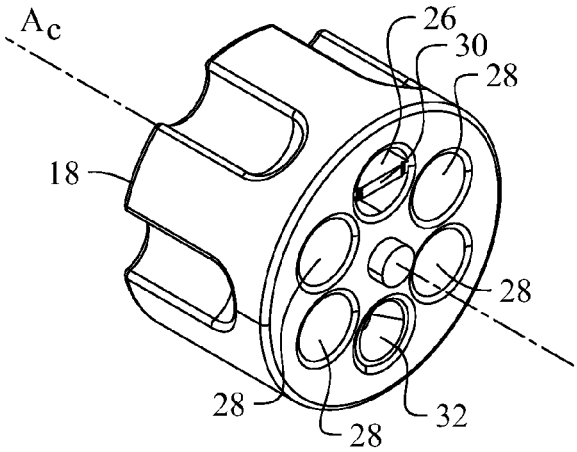
FIGS. 11C and 11D are side perspective views of the cylinder of the beverage dispenser described herein.
Figure 11D:
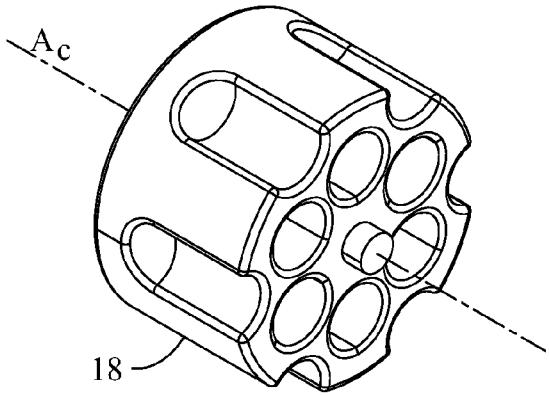

The accompanying Figures and this description depict and describe embodiments of a beverage dispenser in accordance with the present invention, and features and components thereof. It should also be noted that any references herein to front and back, right and left, top and bottom and upper and lower are intended for convenience of description, not to limit the present invention or its components to any one positional or spatial orientation.

Referring to FIGS. 1-10, embodiments of a beverage dispenser 10 in accordance with the present invention are depicted. Each of the depicted embodiments includes a generally gun-shaped (e.g., revolver, pistol, or the like) frame 12 having a barrel portion 14 and a grip portion 22. Each embodiment includes a rotatable cylinder 18 and a trigger mechanism 20 (e.g., for actuating the gun). The depicted embodiments include a liquid receiving and/or containing tank or reservoir 24 (see, e.g., FIG. 15); some embodiments may have more than one such reservoir (not shown) or the reservoir may be capable of receiving a liquid-containing cartridge or cell (see, e.g., FIG. 16). Certain components of the beverage dispenser 10 are common to the depicted embodiments and are commonly numbered in FIGS. 1-10 and the rest of the Figures.

Referring first to FIGS. 1-4, a beverage dispenser according to the preferred of many possible embodiments of the invention is shown. Beverage dispenser 10 includes a frame or housing 12 in shape of a gun, a cylinder 18, and a trigger mechanism 20.

Figure 18:
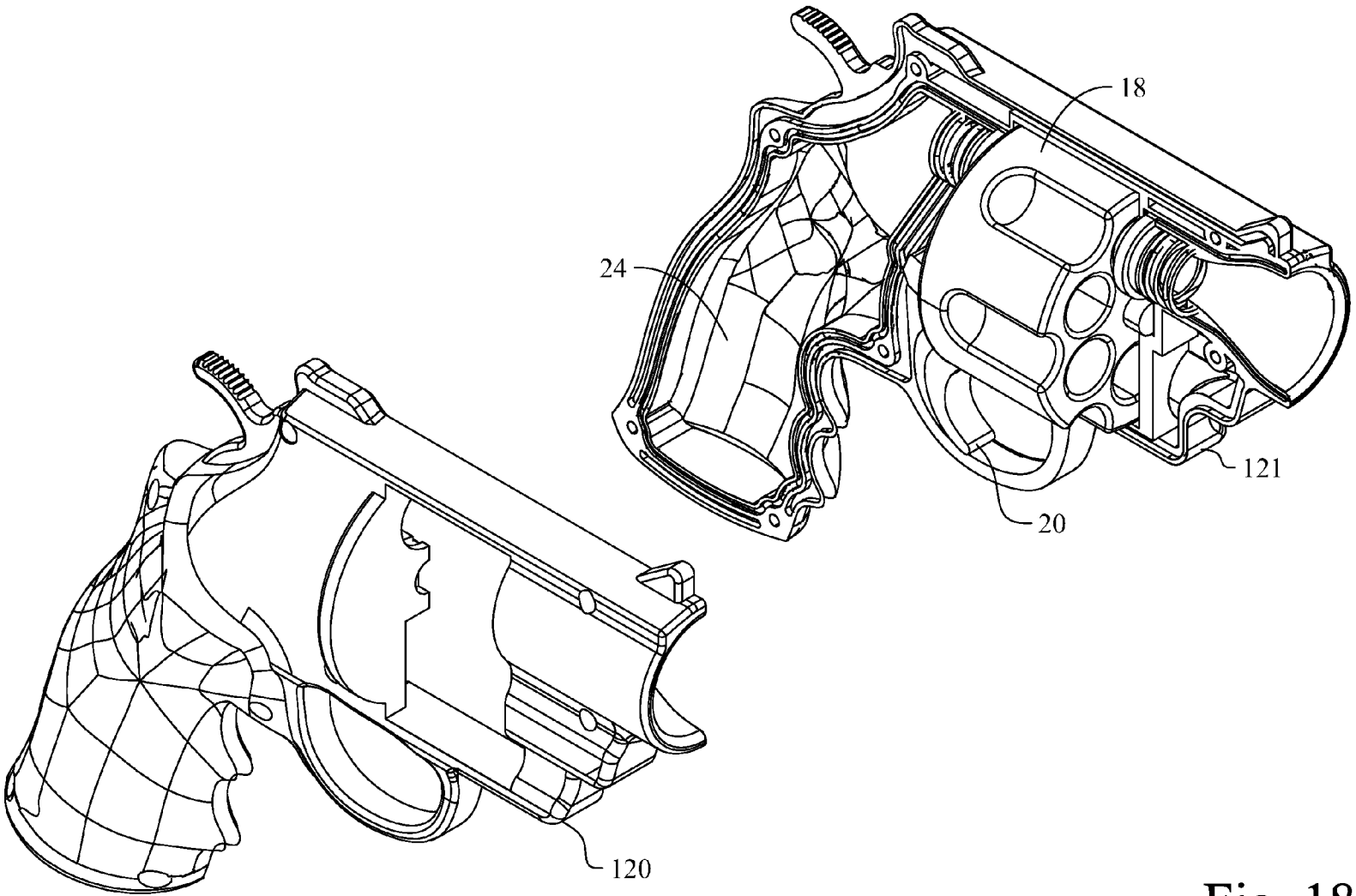
FIGS. 18 and 19 are partially exploded views depicting the internal construction of the exemplary embodiments described herein.
Figure 19:
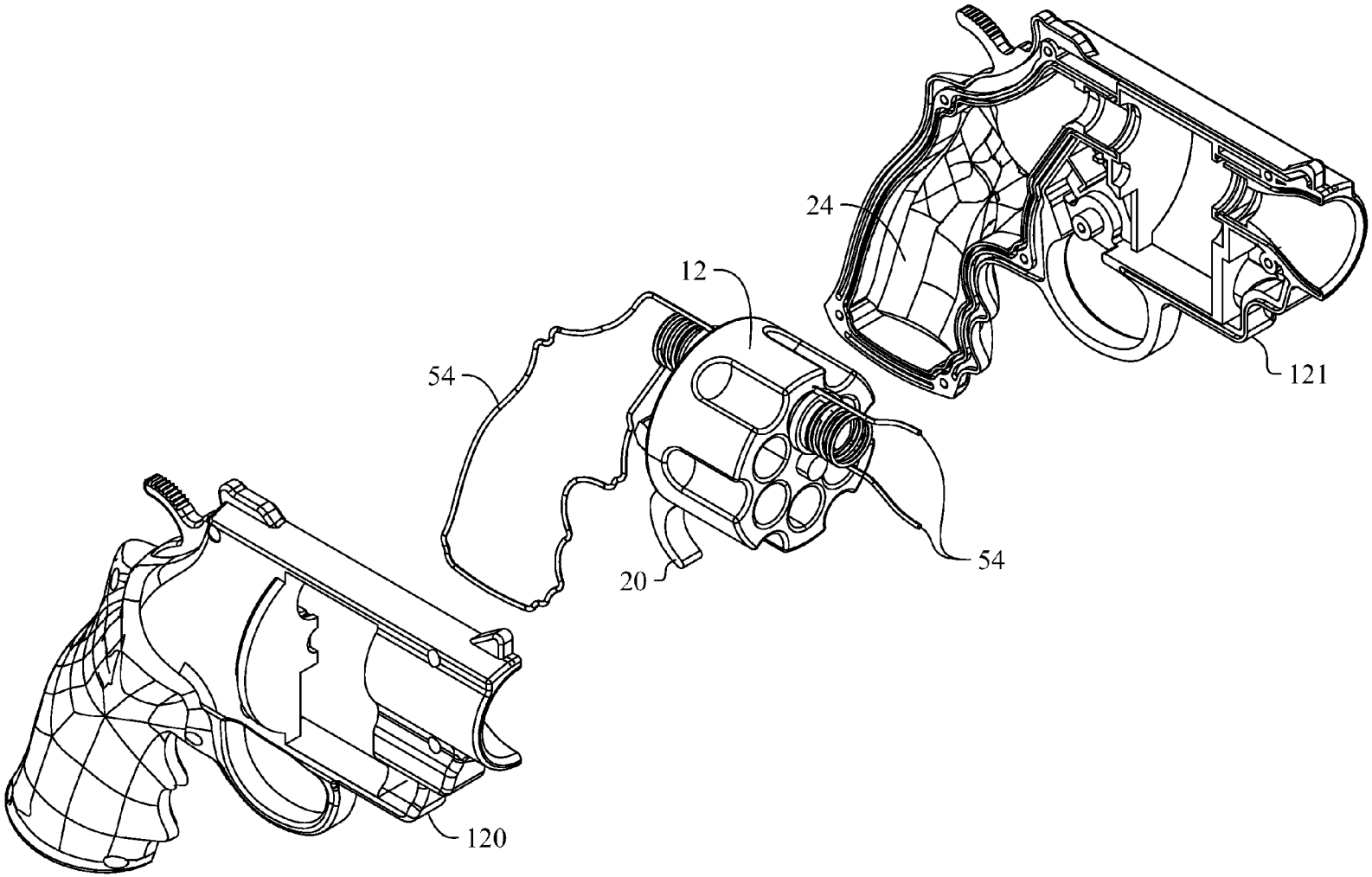
Figure 20:
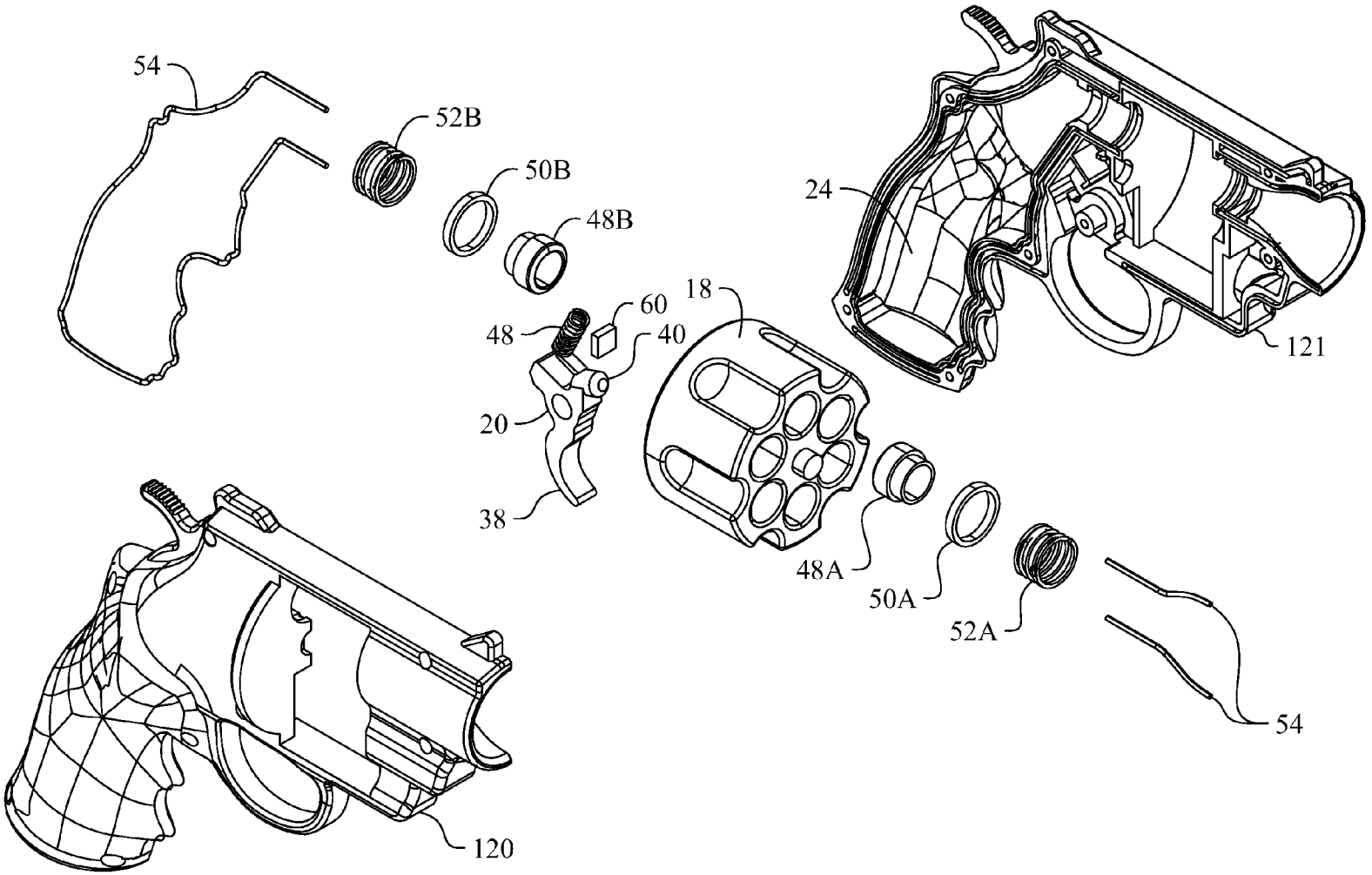
FIG. 20 is an exploded view depicting the internal construction of the exemplary embodiments described herein.

Frame 12 includes a front muzzle end portion 12A and rear frame end portion 12B. The frame 12 is substantially hollow and may be formed as a single piece, or, as best seen in FIGS. 18-20, the frame 12 may be comprised of two halves 120 and 121, which are fastened together in a conventional manner (e.g., screws, integrated snaps, ultrasonic welding, glue, etc.). Similar to a conventional gun or revolver, the frame 12 includes a barrel 14 projecting forwardly from the front muzzle end 12A. The barrel 14 terminates in a muzzle opening 16 (see, e.g., FIGS. 6-10 and 12-14) having a bore centered on a barrel axis ($A_B$) extending rearward towards the rear frame end 12B (see, e.g., FIGS. 7 and 8). Liquid may be introduced to the dispenser via the muzzle opening 16 and liquid exits from the muzzle opening 16 during the dispensing.

With reference to FIGS. 12-14 and 18-20, it can be seen that the frame 12 of beverage dispenser 10 is generally hollow and is adapted to support and/or contain cylinder 18 and trigger mechanism 20. Additionally, frame 12 defines or provides a housing for other components, such as liquid conducting conduits and chambers, electronic components, and the like.

Cylinder 18 is positioned in the frame 12 behind the barrel 14 and is capable of being revolved or rotated about a cylinder axis ($A_C$). The cylinder 18 is typically manually actuated (e.g., by a hand of the user), but may optionally be actuated by electronic components housed in the frame 12. Although cylinder 18 is depicted in the Figures as being substantially cylindrical in shape, in other embodiments the cylinder 18 may be, for example, substantially hexagonal or octagonal. Cylinder 18 includes several chambers, and may include indentations on the cylinder side corresponding to the number of chambers disposed in the cylinder, or the cylinder sides may be smooth. In particular, the cylinder 18 includes a plurality of closed chambers and at least one open chamber. Although the Figures depict a cylinder 18 having six total chambers (one open chamber 26 and five closed chambers 28), it will be understood that, depending on the size of the cylinder 12, any number of open and closed chambers may be provided. Typically, cylinder 18 will include ten or fewer chambers, for example, between six and ten chambers, at least one of which being an open chamber and the remainder of which being closed chambers. In one embodiment, the cylinder includes at least four closed chambers and at least one open chamber. For example, the cylinder may include four closed chambers and one open chamber, five closed chambers and one open chamber, six closed chambers and one open chamber, seven closed chambers and one open chamber, eight closed chambers and one open chamber, or nine closed chambers and one open chamber. In one preferred embodiment, the cylinder includes five closed chambers and one open chamber.

Figure 12:
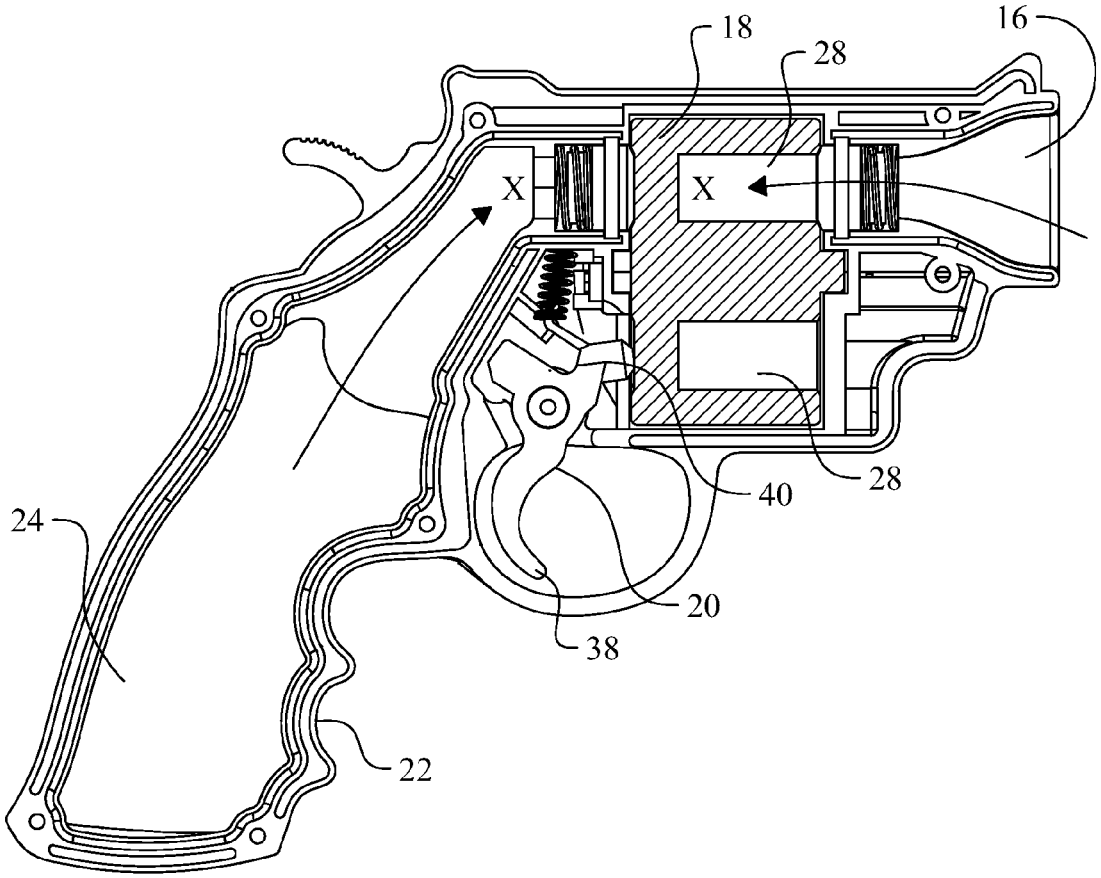
FIGS. 12 and 13 are cross-sectional views showing a closed chamber aligned with the barrel axis.
Figure 13:
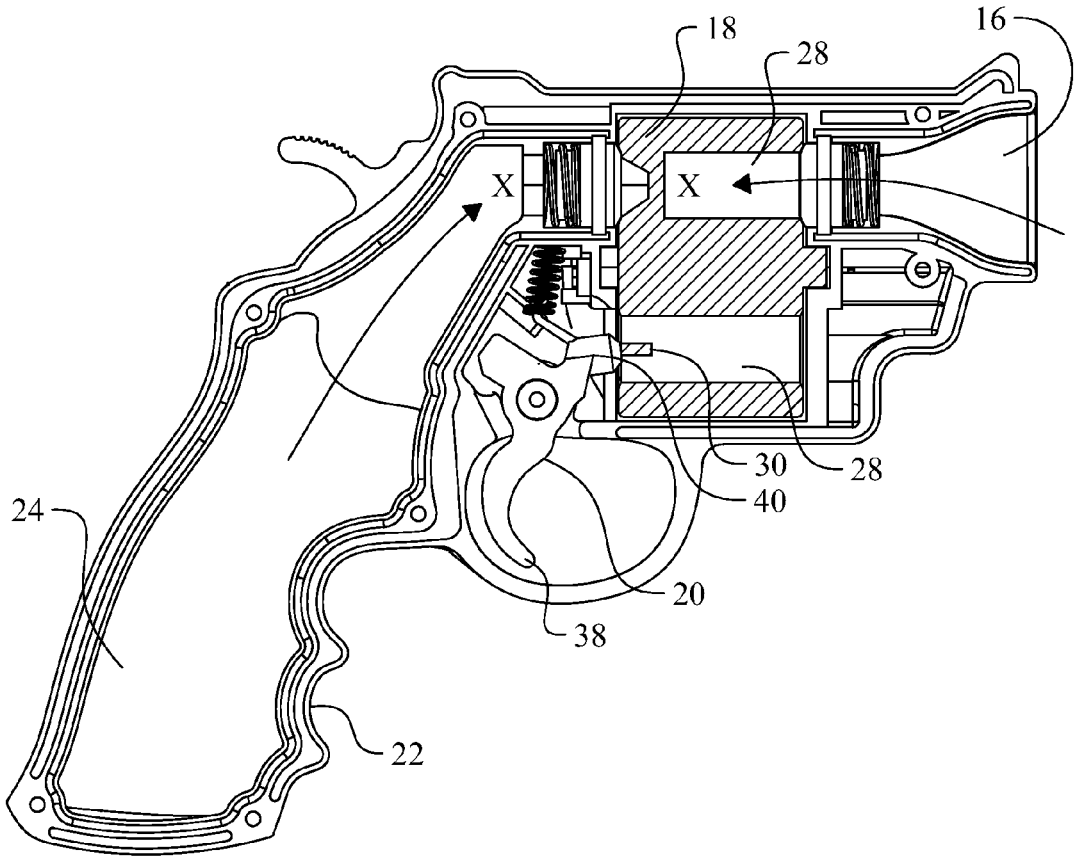
Figure 14:
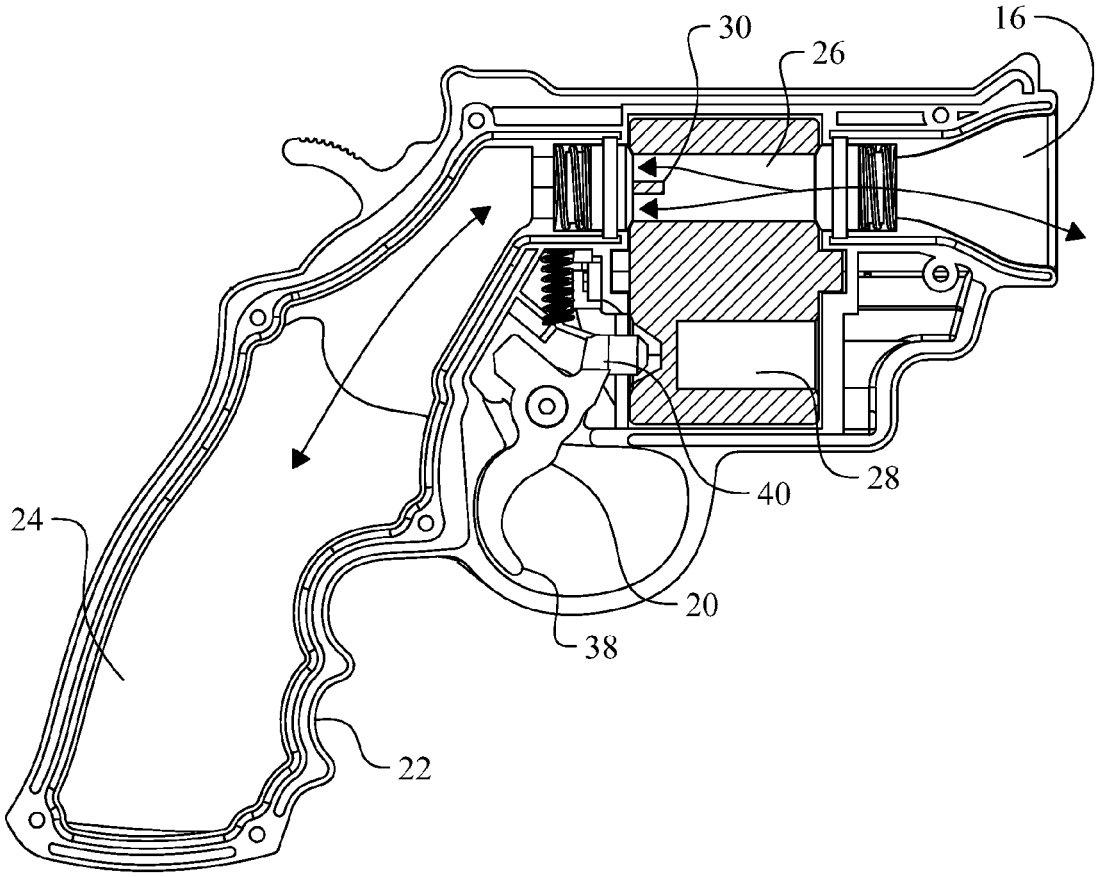
FIG. 14 is a cross-sectional view showing an open chamber aligned with the barrel axis.

Once rotation of the cylinder 18 about the cylinder axis ($A_C$) is complete, whether by manual or electronic actuation, one chamber of the cylinder will generally be positionally aligned with the barrel axis ($A_B$). Thus, when the open chamber 26 is in a position such that it is aligned with the barrel axis ($A_B$), fluid communication between the muzzle opening 16 and the reservoir 24 is substantially allowed. This is generally depicted in FIG. 14, in which the arrows generally indicate the conduit or passageway permitting the flow of liquid in either direction. On the other hand, when a closed chamber 28 is in a position such that it is aligned with the barrel axis ($A_B$), fluid communication between the muzzle opening 16 and the reservoir 24 is substantially prevented. This is generally depicted in FIGS. 12 and 13, in which the arrows generally indicate that liquid is unable to pass through the closed chamber 28. As shown in FIGS. 11A-11C and 14, the open chamber 26 includes a bar 30 or similar structure which allows the passage of liquid through the open chamber but prevents portions of the trigger mechanism 20 from entering the open chamber 26 (as described in detail below).

Figure 15:
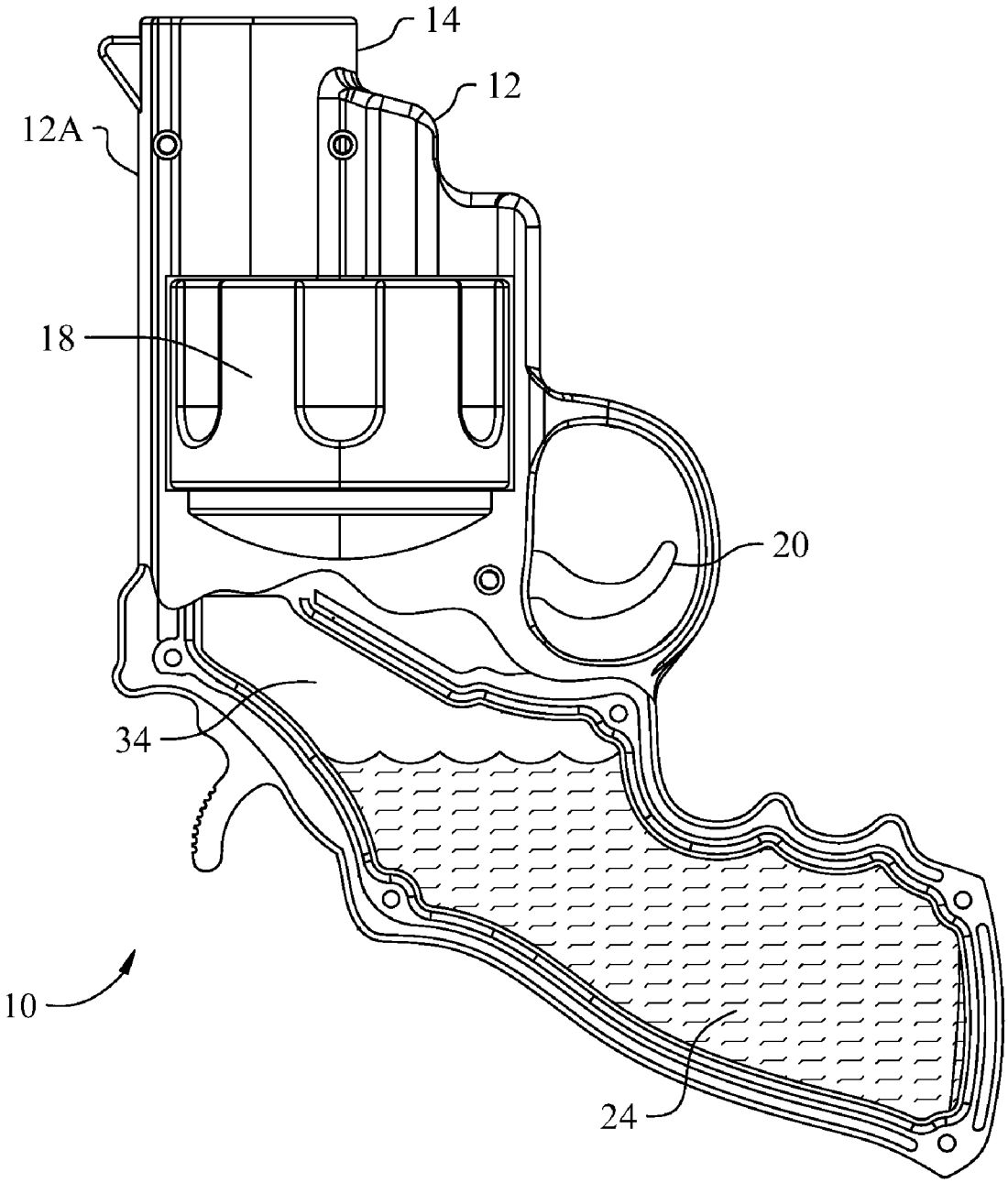
FIG. 15 is a cut-away view depicting the beverage dispenser described herein including a liquid for dispensing.
Figure 16:
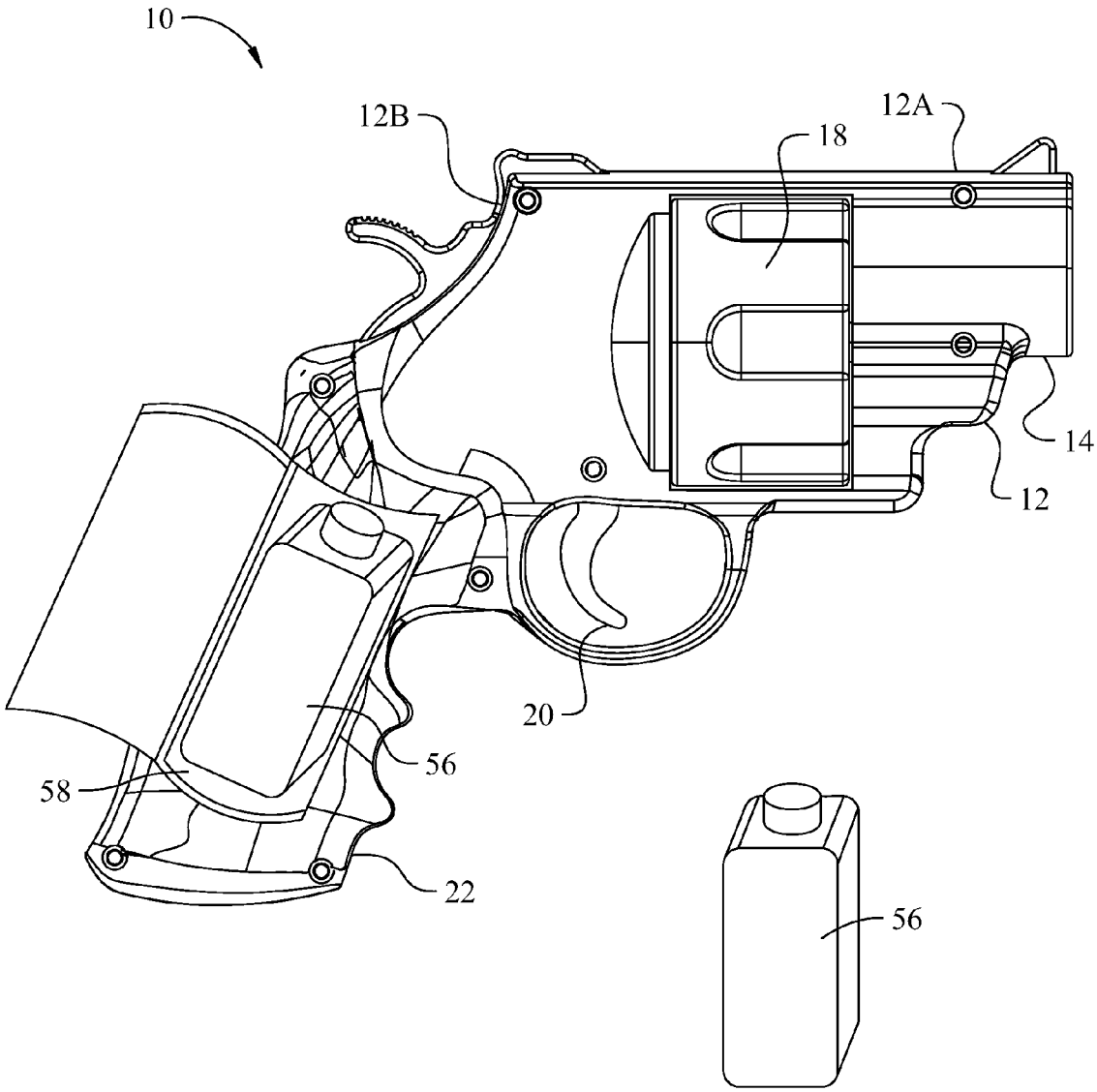
FIG. 16 is a view depicting an alternative exemplary embodiment of the beverage dispenser described herein.

As shown in several of the Figures, the grip 22 is adapted to be held in the hand of a user and defines a tank or reservoir 24 for holding a liquid. As shown in FIG. 15, for example, the reservoir 24 generally has an internal opening 34 through which liquid may enter and/or exit the reservoir 24.

The reservoir 24 can generally be adapted to hold any amount of liquid. It will be understood, however, that a higher capacity reservoir may render the beverage dispenser unsuitable for gripping by a single hand of a user, or even by two hands, and may otherwise render the beverage dispenser unwieldy or difficult to maneuver. This may make the beverage dispenser prone to droppage or spillage, among other, more acute, safety concerns (e.g., the consumption of large amounts of alcohol). In general, the capacity of the reservoir can be increased by increasing the overall size of the grip 22 or the rear frame portion 12B. Typically, the capacity of the reservoir is from about 15 mL to about 500 mL. In one embodiment, the capacity of the reservoir is from about 30 mL to about 475 mL. In another embodiment, the capacity of the reservoir is from about 30 mL to about 355 mL. In another embodiment, the capacity of the reservoir is from about 30 mL to about 90 mL; more preferably in this embodiment from about 30 mL to about 74 mL.

The outer surface of grip 22 may be substantially smooth or may be provided or adorned with a plurality of raised protrusions, indentations, ridges, or channels on or around the outer circumference of the grip to increase the surface area of the grip coming in contact with the user's hand and improve the grip of the user. Such exemplary ridges and indentations can be seen, for example, in FIGS. 1-10. A beverage dispenser 10 without such ridges and indentations may also be provided. Additionally, as shown in various Figures, the grip may also include finger indentations 36 provided on the front portion of the grip where the fingers of a user are positioned when holding the dispenser. The outer surface of the grip 22 may additionally or alternatively be wrapped or coated with a material to improve shock absorption, cushiness/cushioning, tackiness, traction when wet, or otherwise improve the handling of the grip and dispenser by a user. Such materials may include rubber, polyurethane, leather (natural or synthetic), cork (natural or synthetic), sandpaper, and the like. The grip 22 may also be fitted with grip inlays made of similar or other materials.

The outer surfaces of the frame 12, the barrel 14, the cylinder 18, the trigger mechanism 20, and/or the grip 22, or any other part or portion, may also be adorned with words, logos, and other indicia such as sports team logos and mascots, school or business identifiers or logos, directions or instructions for use, disclaimers, advertising indicia, national or historic landmarks, food and beverage indicia, political insignia, and the like.

As best seen in FIGS. 12-14, trigger mechanism 20 is pivotally mounted to the frame 12 with a first trigger end 38 projecting from the frame such that it is actuatable by the user and a second trigger end 40 disposed in the frame. Generally speaking, the trigger has two positions. The first and normal position being a generally static position into which the trigger 20 is biased by a common torsion spring 42 (or by other means common in the prior art). In the static position, first end 38 is positioned forwardly as shown in FIGS. 1-10, 12 and 13. The second trigger position is the actuated position with first end 38 forced rearwardly, against its normal bias, as shown in FIG. 14. Depending on the position of the cylinder, first end 38 may be prevented from being depressed or forced rearwardly, or may move only slightly (e.g., 1-2 mm), by virtue of second end 40 abutting against one of the closed chambers 28 or the bar 30 in the open chamber 26. If, for example, the cylinder 18 is positioned such that the second trigger end 40 is aligned with an open chamber 26, the second end 40 can abut against bar 30 and prevent or substantially prevent the trigger mechanism 20 from being actuated. As shown in FIG. 13, the bar 30 is generally disposed across the diameter of the open chamber 26 and prevents second trigger end 40 from entering the open chamber 26, yet bar 30 does not substantially restrict or prevent the flow of liquid through the open chamber 26 when the cylinder 18 is positioned such that the passageway is formed from the reservoir 24 to the muzzle opening 16 and vice versa. If, on the other hand, the position of the cylinder 18 is such that the open chamber 26 is aligned with the barrel axis and the passageway from the muzzle opening 16, barrel 14, and reservoir 24 is formed, the trigger mechanism 20 can be actuated or depressed with second trigger end 40 entering the inset portion 32 of the cylinder 18. In this way, the user's ability or inability to depress or squeeze the first trigger end 38 is used to signify to the user whether the cylinder 18 and the open chamber 26 are in a position to allow the flow of liquid from the reservoir 24 to the muzzle opening 16 and into the mouth of the user.

Disposed generally at the rear frame end 12B is a hammer 44, which may be movable or stationary (i.e., molded as part of the frame 12). Typically, the hammer 44 is stationary. In embodiments in which the beverage dispenser 10 includes a movable hammer, the hammer 44 can be actuated by the thumb of the user in a downward direction towards the user holding the grip. In embodiments in which the liquid is projected or ejected from the dispenser, for example, the hammer may be used to engage a fluid transfer system (described elsewhere herein) for generating forces for dispensing the liquid. Additionally or alternatively, the hammer 44 can be actuated by the thumb of a user to cause the hammer (or internal portions thereof) to respectively engage with and disengage from an anchor or lock to respectively lock and unlock the rotational capabilities of the cylinder. The frame 12 may also include one or more conventional handgun sight structures 46.

In order to fill beverage dispenser 10 with a liquid, the cylinder 18 is first rotated to the position in which the open chamber 26 forms the conduit or passageway from the muzzle opening 16 to the reservoir 24. Liquid may then be poured into the muzzle opening 16, passing through the open chamber 26 and internal opening 34, ultimately collecting in the reservoir 24. When filled and in use, the beverage dispenser is typically held upright (see FIG. 15), in order to substantially prevent liquid from leaking from the reservoir 24 and/or through the closed or open chambers and out the muzzle opening 16.

As best shown in FIG. 20, seal plungers 48A and 48B, and sleeves or rings 50A and 50B may be provided to form a seal between the cylinder 18 and the chambers thereof, and the frame 12 by the matching contours of their mating surfaces and the force applied by springs 52A and 52B. Seal plungers 48A and 48B and sleeves 50A and 50B may be formed from flexible material such as plastic, polyurethane, or silicon rubber. It will be understood that the bias of springs 52A and 52B is sufficient cause the various plungers and sleeves to form a sufficient seal, while still allowing the cylinder to substantially freely spin or rotate. It will also be understood that springs 52A and 52B can be replaced with other biasing components to form the seal. Various sealing strips 54 may also be provided in between the two halves of the frame 120 and 121, to form a seal between these (and other) components to substantially prevent liquid from leaking from the reservoir 24 or other parts of the frame 12. Other sealing components may also be provided to seal off electronic or motor components (see, e.g., FIGS. 21A and 21B) from the liquid chambers and passageways.

As noted above, the beverage dispenser 10 is typically filled by pouring liquid through the muzzle opening 16. In certain embodiments, however, the grip 22 may optionally include a filler opening (not shown) for providing fluid access to the reservoir 24. The filler opening may be provided with a removable cap which may attach to grip 22 and/or reservoir 24 using a threaded or snap-on type connection. The removable cap may be optionally provided with a retainer to keep the cap attached to the grip and/or reservoir, such as when a user is filling the beverage dispenser.

Figure 17:
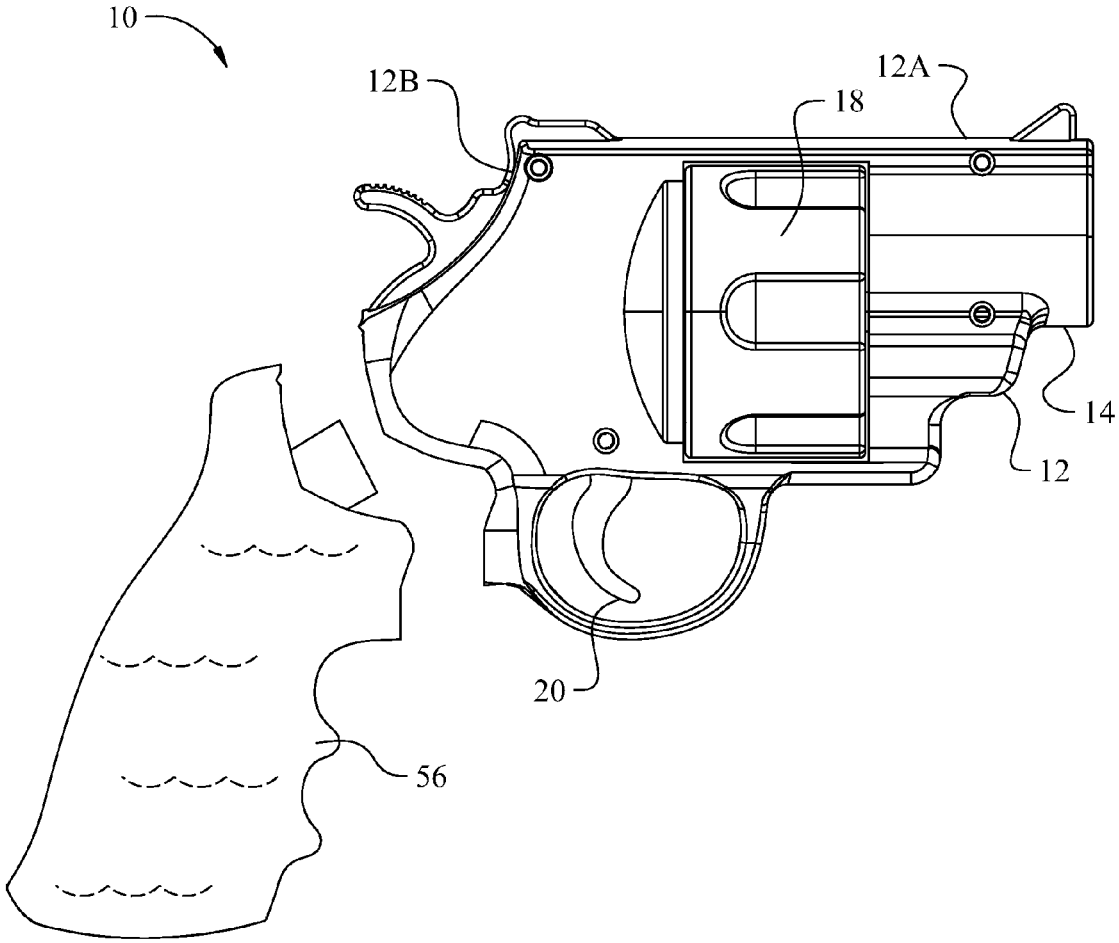
FIG. 17 is a view depicting an alternative exemplary embodiment of the beverage dispenser described herein.

The beverage dispenser may also be adapted to receive a cell or cartridge containing the liquid. Thus, for example, the beverage dispenser could be shaped like a rifle and the cell or cartridge could have the general shape and design of a shotgun shell. By way of another example, the beverage dispenser could be shaped like a pistol or machine gun and receive, in the grip or other area of the beverage dispenser, a cell or cartridge having the general shape and design of a (detachable or disposable) clip or magazine containing the liquid. In a particular embodiment generally depicted in FIG. 16, the grip 22 may be adapted to receive a cell or cartridge 56 containing a liquid. The cell or cartridge 56 may be introduced to the reservoir 24, for example, by way of a hatch or opening 58 provided in a wall of the grip. It will be understood that cell or cartridge 56 is not limited to the rectangular shape shown, and may instead be cylindrical or other shape capable of fitting within the grip 22, including a flexible bag or pouch containing the liquid. Alternatively, cell or cartridge 56 may be a glass or other container (e.g., a shot glass). In other embodiments generally depicted in FIG. 17, the cell 56 may form all or part of the grip 22 when attached or otherwise secured to the beverage dispenser 10 (e.g., at the grip 22 or the frame 12). Another aspect of the invention, therefore, is directed to liquid-containing cells or cartridges adapted to be inserted or attached to the beverage dispenser described herein. The cartridges or cells may be refillable or disposable and may contain a wide range of alcoholic and non-alcoholic beverages (such as those described below). In one embodiment, the cartridge or cell includes a liquid selected from beer, wine, malt liquor, gin, whiskey, vodka, schnapps (e.g., peppermint, butterscotch, peach, etc.), tequila, scotch, rum, and combinations thereof.

As discussed above, the user's ability to completely depress the trigger signifies that the cylinder is positioned such that open chamber in the cylinder forms the conduit between the muzzle opening and the reservoir (as discussed above) and that the user should position the muzzle opening at or near the user's lips and drink the liquid from the dispenser (i.e., as if from a glass or shot glass). In other embodiments, the beverage dispenser may include a fluid transfer system designed to create and/or release forces for propelling or ejecting the liquid from the reservoir through the open chamber and out of the muzzle opening into the mouth of a user.

In certain preferred embodiments, beverages are dispensed from the beverage dispenser utilizing the force of gravity; that is, the liquid is poured from the dispenser. It will be understood that this method of dispensing is generally preferred for safety reasons. In certain other embodiments, beverages may be projected or ejected from the dispenser using one or more fluid propulsion mechanisms.

With regard to the manner in which liquid may be projected or ejected toward the muzzle opening upon depression of a trigger or other means, the beverage dispenser may include, for example, a spring-loaded system, an on-board pump for pressurizing a liquid-containing, fixed-volume chamber or chamber region with air (such as described in U.S. Pat. No. 7,458,485), a motorized system (such as described in U.S.

Pat. No. 4,022,350), an expandable bladder dimensioned and arranged to receive and store liquid from a pressurized source (such as described in U.S. Pat. Nos. 4,854,480 and 4,735,239), or the dispenser may utilized both a bladder for storing pressurized liquid and an on-board, manually operated, fluid transfer pump for transferring fluid from an unpressurized chamber having a fill cap to the bladder (such as described in U.S. Pat. No. 5,875,927). The manner in which liquid ejection forces are developed is of no particular consequence except insofar as manufacturing cost, simplicity and ease of use are always considerations to be borne in mind.

The user can be informed of the positional alignment of the cylinder and open and closed chambers in a variety of ways. For example, actuation of the trigger mechanism may activate a light, sound, vibration, or other notice. Or, as noted above, the user may or may not be able to actuate the trigger depending on the cylinder position.

In certain embodiments, the user can be informed of the positional alignment of the cylinder by a mechanically actuated "clicker" structure 60. In operation, a portion of the second trigger end 40 strikes structure 60, producing a clicking sound, when the cylinder 18 is positioned such that second trigger end 40 is capable of entering the inset portion 32, thus the "click" signifies that the open chamber is positionally aligned with the barrel axis. When the cylinder 18 is positioned such that second trigger end 40 will abut against a closed chamber, the second trigger end 40 will not substantially move and thus will not strike structure 60.

The beverage dispenser 10 may optionally include one or more electronic components, e.g., for emitting light, sound, and/or vibration, or for spinning the cylinder 18. Electronic components of the device may use conventional, commercially available electronic components, connectors and devices such as suitable wiring, connectors, printed circuit boards, microchips, speakers, lights, LED's, liquid crystal displays, pressure sensors, liquid level sensors, motors (e.g., a motor for spinning the cylinder 18 or a motor holding unbalanced weight resulting in wobbling which translate to vibrations of the beverage dispenser itself), audio components, inputs, outputs and the like. For instance, the beverage dispenser may be equipped with an LED or other visual indicator that informs a user that the reservoir of the dispenser is empty or full. By way of another example, the beverage dispenser may be equipped with an LED or other visual indicator that informs a user that the cylinder and the open chamber are in a position to complete the passageway or conduit from the reservoir to the muzzle opening and into the mouth of the user, or that the passageway is closed due to the positioning of a closed chamber. In a similar manner, the beverage dispenser may be equipped with a sound chip and a speaker that audibly communicates to the user(s) that the reservoir is full. By way of another example, the sound chip and speaker can be activated by the pulling of the trigger and can audibly inform the user that the cylinder and the open chamber are in a position that completes the passageway or conduit from the reservoir to the muzzle opening and into the mouth of the user, or that the passageway is closed due to the positioning of a closed chamber. Representative words and sounds that may emanate from the dispenser include clicking or gunshots, a simulated sound of the cylinder spinning, the word "DRINK!", and the like.

Figure 21A:
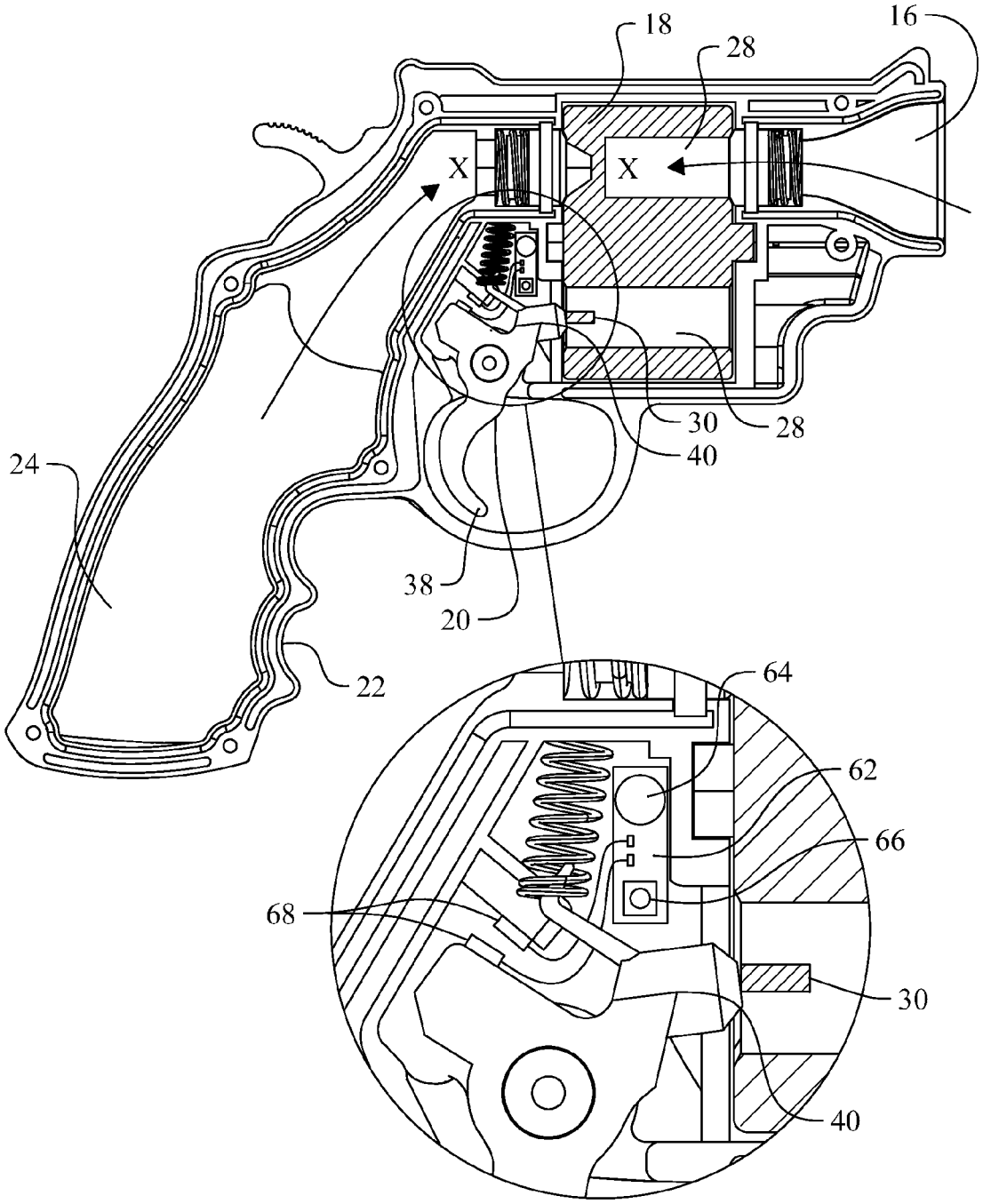
FIGS. 21A and 21B are cross-sectional views showing an exemplary embodiment including electronic components.
Figure 21B:
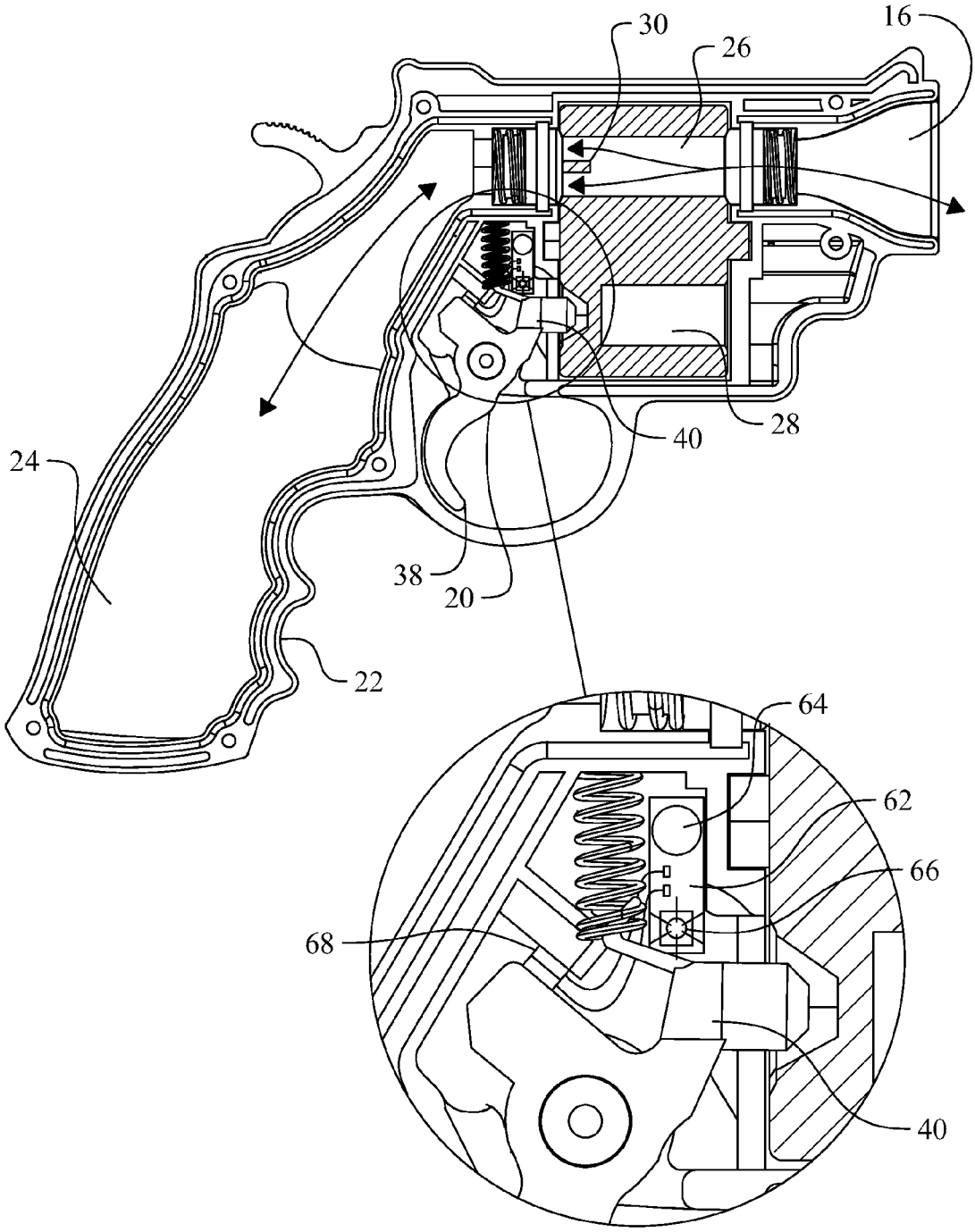

An exemplary embodiment of a beverage dispenser 10 including electronic components is depicted in FIGS. 21A and 21B, in which the magnified portion shows a circuit board 62, battery 64 (e.g., button cell), and LED 66, connected to the trigger mechanism 20 through leads 68. As shown in FIG. 21A, the closed chamber 28 is aligned with the barrel axis and thus the leads 68 will not engage. In FIG. 21B, the open chamber 26 is aligned with the barrel axis and thus the second trigger end 40 moves into the inset portion, causing the leads 68 to engage, illuminating the LED 66. As noted above, these electronic components may generally be housed anywhere within the frame, but preferably in the location shown or other some location that is sealed off from the liquid chambers and passageways.

With regard to fastening, mounting, attaching or connecting components of the present invention to form the beverage dispenser as a whole, unless specifically described otherwise, such are intended to encompass conventional fasteners such as screws, nut and bolt connectors, threaded connectors, snap rings, detent arrangements, clamps such as screw clamps and the like, rivets, toggles, pins, and the like. Components may also be connected by adhesives, glues, welding, ultrasonic welding, and friction fitting or deformation, if appropriate, and appropriate liquid and/or airtight seals or sealing devices may be used. Unless specifically otherwise disclosed or taught, materials for making components of the present invention may be selected from appropriate materials such as metal, metallic alloys, natural and man-made fibers, vinyls, plastics and the like, and appropriate manufacturing or production methods including casting, pressing, extruding, molding and machining may be used.

The dispenser of the present invention and methods of using the same may be used with alcoholic beverages, non-alcoholic beverages, and combinations thereof. Alcoholic beverages which may be dispensed by the beverage dispenser described herein may include, for example, mashes prepared from fermented grains (such as barley, corn, rye, or wheat) and alcoholic beverages derived from fermented grains, e.g., bourbon, gin, rye, schnapps, vodka, whiskey, and/or beer. Other non-limiting examples of alcoholic mixtures include those derived from fermented fruits, e.g., brandy, cognac, sherry, and wine; fermented juices derived from sugar cane and/or sugar beets, e.g., rum; or fermented juices derived from the head of the *agave tequilana* weber, e.g., tequila (including conventional tequila, conventional tequila blanco, conventional tequila reposado (aged in an oak barrel for at least 2 months), or conventional tequila a ejo (aged in an oak barrel for at least 12 months)). It will be understood that the alcoholic mixture can be in any stage of refinement, such as a fermented mash, or an alcoholic beverage. In one embodiment, the liquid is selected from beer, wine, malt liquor, gin, whiskey, vodka, schnapps (e.g., peppermint, butterscotch, peach, etc.), tequila, scotch, rum, and combinations thereof. It will be understood that the dispensing and/or consumption of alcoholic beverages by the instant dispenser should only be employed by users that have reached the legal drinking age (e.g., twenty-one years of age and older).

What is claimed is:

1. A beverage dispenser comprising a frame, the frame having a front muzzle end and a rear frame end;

a grip extending downward from the rear frame end of the frame and adapted to be held in a hand of a user, the grip defining a reservoir for holding a liquid;

a barrel projecting forwardly from the front muzzle end and terminating in a muzzle opening having a bore centered on a barrel axis extending rearward towards the rear frame end;

a trigger mechanism comprising a trigger projecting downward from the frame forward of the grip and actuatable by a finger of the hand of the user holding the grip;

a cylinder received in the frame rearward of the barrel and rotatable about a cylinder axis generally parallel to the barrel axis, the rotatable cylinder having a plurality of closed chambers and at least one open chamber, wherein the open chamber, when positionally aligned with the barrel axis, substantially allows fluid communication between the muzzle opening and the reservoir, and wherein any one of the closed chambers, when positionally aligned with the barrel axis, substantially prevents fluid communication between the muzzle opening and the reservoir.

2. The beverage dispenser of claim 1 wherein the frame is formed in the shape of a revolver.

3. The beverage dispenser of claim 1 wherein the trigger mechanism further comprises an end portion positioned in the frame and adapted to communicate with the open and closed chambers of the cylinder and inform the user whether the open chamber or any one of the closed chambers is positionally aligned with the barrel axis.

4. The beverage dispenser of claim 3 wherein the user is informed of the positional alignment by an ability or an inability to actuate the trigger.

5. The beverage dispenser of claim 3 wherein the user is informed of the positional alignment by a light, sound, vibration, or other notice emanating from the beverage dispenser.

6. The beverage dispenser of claim 1 wherein the reservoir has a capacity of from about 30 mL to about 475 mL.

7. The beverage dispenser of claim 1 wherein the reservoir has a capacity of from about 30 mL to about 90 mL.

8. The beverage dispenser of claim 1 wherein the reservoir has a capacity of from about 30 mL to about 74 mL.

9. The beverage dispenser of claim 1 wherein the cylinder includes at least four closed chambers and at least one open chamber.

10. The beverage dispenser of claim 1 wherein the cylinder includes five closed chambers and one open chamber.

11. A beverage dispenser comprising a frame, the frame having a front muzzle end and a rear frame end;

a grip extending downward from the rear frame end of the frame and adapted to be held in a hand of a user, the grip defining a reservoir for holding a liquid;

a barrel projecting forwardly from the front muzzle end and terminating in a muzzle opening having a bore centered on a barrel axis extending rearward towards the rear frame end;

a trigger mechanism comprising a trigger projecting downward from the frame forward of the grip and actuatable by a finger of the hand of the user holding the grip;

a cylinder received in the frame rearward of the barrel and rotatable about a cylinder axis generally parallel to the barrel axis, the rotatable cylinder having a plurality of closed chambers and at least one open chamber, wherein the open chamber, when positionally aligned with the barrel axis, substantially allows fluid communication between the muzzle opening and the reservoir, wherein any one of the closed chambers, when positionally aligned with the barrel axis, substantially prevents fluid communication between the muzzle opening and the reservoir, and wherein the trigger mechanism, when actuated by the user, informs the user of the positional alignment of the open and closed chambers.

12. The beverage dispenser of claim 11 wherein the frame is formed in the shape of a revolver.

13. The beverage dispenser of claim 11 wherein the trigger mechanism, when actuated by the user, activates a light, sound, vibration, or other notice that informs the user of the positional alignment of the open and closed chambers.

14. The beverage dispenser of claim 11 wherein the reservoir has a capacity of from about 30 mL to about 74 mL.

15. The beverage dispenser of claim 11 wherein the cylinder includes five closed chambers and one open chamber.

16. A beverage dispenser comprising a frame formed in the shape of a revolver, the frame having a front muzzle end and a rear frame end;

a grip extending downward from the rear frame end of the frame and adapted to be held in a hand of a user, the grip defining a chamber for holding a cartridge containing a liquid;

a barrel projecting forwardly from the front muzzle end and terminating in a muzzle opening having a bore centered on a barrel axis extending rearward towards the rear frame end;

a trigger mechanism comprising a trigger projecting downward from the frame forward of the grip and actuatable by a finger of the hand of the user holding the grip;

a cylinder received in the frame rearward of the barrel and rotatable about a cylinder axis generally parallel to the barrel axis, the rotatable cylinder having a plurality of closed chambers and at least one open chamber, wherein the open chamber, when positionally aligned with the barrel axis, substantially allows fluid communication between the muzzle opening and the reservoir, wherein any one of the closed chambers, when positionally aligned with the barrel axis, substantially prevents fluid communication between the muzzle opening and the reservoir, and wherein the trigger mechanism, when actuated by the user, informs the user of the positional alignment of the open and closed chambers.

17. The beverage dispenser of claim 16 wherein the frame is formed in the shape of a revolver.

18. The beverage dispenser of claim 16 wherein the user is informed by a light, sound, vibration, or other notice emanating from the beverage dispenser.

19. The beverage dispenser of claim 16 wherein the reservoir has a capacity of from about 30 mL to about 74 mL.

20. The beverage dispenser of claim 16 wherein the cylinder includes five closed chambers and one open chamber.

21. A method of playing a game of chance, the method comprising providing the beverage dispenser of claim 1, filling the reservoir with a liquid, rotating the cylinder, and actuating or attempting to actuate the trigger mechanism to inform the user about a position of the open and closed chambers, and drinking the liquid from the beverage dispenser or passing the beverage dispenser to another player depending on the position of the open and closed cylinders.

* * * * *